US010677403B1

(12) United States Patent
Li et al.

(10) Patent No.: US 10,677,403 B1
(45) Date of Patent: Jun. 9, 2020

(54) EASY-TO-INSTALL LIGHT-EMITTING DIODE DOUBLE-RING CEILING LAMP

(71) Applicant: ZHEJIANG YANKON MEGA LIGHTING CO., LTD., Shaoxing, Zhejiang (CN)

(72) Inventors: Yang Li, Zhejiang (CN); Liming Wang, Zhejiang (CN); Yong Ding, Zhejiang (CN); Jingwei Zhou, Zhejiang (CN); Hongqiang Xu, Zhejiang (CN); Guoquan Ding, Zhejiang (CN)

(73) Assignee: ZHEJIANG YANKON MEGA LIGHTING CO., LTD., Shaoxing, Zhejiang (CN)

( * ) Notice: Subject to any disclaimer, the term of this patent is extended or adjusted under 35 U.S.C. 154(b) by 0 days.

(21) Appl. No.: 16/362,564

(22) Filed: Mar. 22, 2019

(30) Foreign Application Priority Data

Nov. 23, 2018 (CN) ..... 2018 2 1937027 U

(51) Int. Cl.

| | |
|---|---|
| ***F21S 8/04*** | (2006.01) |
| ***F21V 21/03*** | (2006.01) |
| ***F21V 17/12*** | (2006.01) |
| ***F21V 3/06*** | (2018.01) |
| *F21Y 115/10* | (2016.01) |

(52) U.S. Cl.
CPC ..... *F21S 8/043* (2013.01); *F21V 3/0615* (2018.02); *F21V 17/12* (2013.01); *F21V 21/03* (2013.01); *F21Y 2115/10* (2016.08)

(58) Field of Classification Search
CPC ..... F21V 17/164; F21V 17/002; F21V 17/10; F21V 17/102; F21V 17/107; F21V 17/12; F21V 3/061; F21V 3/0615; F21V 21/03; F21K 9/20; F21K 9/66; F21S 8/026; F21S 8/03; F21S 8/04; F21S 8/043
See application file for complete search history.

(56) References Cited

U.S. PATENT DOCUMENTS

| | | | | |
|---|---|---|---|---|
| 2004/0109322 | A1* | 6/2004 | Desanto | F21S 8/04 362/372 |
| 2010/0142202 | A1* | 6/2010 | Sugishita | F21S 8/026 362/235 |
| 2016/0178186 | A1* | 6/2016 | Kusunoki | F21V 29/20 362/373 |
| 2017/0191629 | A1* | 7/2017 | Treadway | F21V 3/061 |
| 2018/0259163 | A1* | 9/2018 | Harris | F21V 17/002 |

* cited by examiner

*Primary Examiner* — Anh T Mai
*Assistant Examiner* — Steven Y Horikoshi
(74) *Attorney, Agent, or Firm* — Yue (Robert) Xu; Apex Attorneys at Law, LLP

(57) ABSTRACT

The present application relates to an easy-to-install LED double-ring ceiling lamp, including a base plate, a LED light source board, a driving power supply, a translucent cover and a press ring. The LED light source board and the driving power supply are installed on the base plate, the translucent cover is covered on the base plate, and the press ring is covered outside the translucent cover and configured to support the translucent cover. The press ring and the base plate are detachably connected by multiple installation column-shaped bolts, and at least one of the multiple installation column-shaped bolts is a bendable installation column-shaped bolt.

10 Claims, 5 Drawing Sheets

EASY-TO-INSTALL LIGHT-EMITTING DIODE DOUBLE-RING CEILING LAMP

CROSS-REFERENCE TO RELATED APPLICATIONS

This application claims the priority to Chinese Patent Application No. 201821937027.3, titled "EASY-TO-INSTALL LIGHT-EMITTING DIODE DOUBLE-RING CEILING LAMP", filed on Nov. 23, 2018 with the National Intellectual Property Administration, PRC, which is incorporated herein by reference in its entirety.

FIELD

The present application relates to the field of light-emitting diode (LED) illumination technology, and in particular to an easy-to-install LED double-ring ceiling lamp.

BACKGROUND

A ceiling lamp is a lamp adsorbed on a ceiling of a roof or embedded therein, and it is generally used in places such as homes and offices. A conventional ceiling lamp generally adopts a light plastic translucent cover, and the translucent cover is fastened onto a base plate, which is easy to be installed. However, the hardness of the plastic translucent cover is low, a surface thereof is easy to be scratched, and the heat dissipation is not very well, the surface of the plastic translucent cover is easy to turn yellow after a long time, thereby affecting the luminous flux. In view of this, some manufacturers began to use a glass translucent cover to address the shortcomings of the plastic translucent cover. However, the glass translucent cover is too heavy to be fastened onto the base plate, hence a double-ring ceiling lamp is appeared on the market, which, in addition to the base plate, further has a special press ring for supporting the glass translucent cover. The double-ring ceiling lamp includes a base, a light-emitting diode (LED) light source board, a driving power supply, a glass translucent cover and a press ring. The base plate is a metal disc having a platform at the periphery, the LED light source board and the driving power supply are installed on an inner bottom surface of the base plate, and multiple installation column-shaped bolts are provided on the platform at the periphery of the disc. The glass translucent cover is covered on the base plate, the press ring is covered on the translucent cover, and then the press ring is locked onto the installation column-shaped bolts by nuts, and thus the translucent cover is fixed between the base plate and the press ring. This installation method needs to install the glass translucent and the press ring at the same time, the press ring needs to be supported by both hands during installation, it is not convenient for a man to work with an upturned face at a high altitude, and in addition, the glass translucent cover is fragile, thus it is easy to be broken when something goes wrong during installation.

SUMMARY

An object of the present application is to provide an easy-to-install light-emitting diode (LED) double-ring ceiling lamp, the installation method of which is simple and can be easily operated by one person, and it can effectively avoid accidental falling of the translucent cover during installation. In order to achieve the above object, the following technical solution is provided according to the present application.

An easy-to-install light-emitting diode (LED) double-ring ceiling lamp includes: a base plate, a LED light source board, a driving power supply, a translucent cover and a press ring. The LED light source board and the driving power supply are installed on the base plate, the translucent cover is covered on the base plate, the press ring is covered outside the translucent cover and configured to support the translucent cover, the press ring and the base plate are detachably connected by a plurality of installation column-shaped bolts, and at least one of the plurality of installation column-shaped bolts is a bendable installation column-shaped bolt.

The bendable installation column-shaped bolts includes a fixing part and a bending part, a top end of the fixing part is connected to the base plate, a bottom end of the fixing part is hinged with a top end of the bending part, and a bottom end of the bending part is connected to the press ring.

The top end of the fixing part is integrally connected to the base plate.

A threaded hole is provided in the top end of the fixing part, a threaded column-shaped bolt is provided on the base plate, and the top end of the fixing part is threadedly connected to the threaded column-shaped bolt.

A lug is provided at a bottom of the fixing part, and a through hole is provided in the lug; a straight slot for accommodating the lug is provided in a top of the bending part, and through holes are provided symmetrically in side walls of the straight slot, the lug is embedded into the straight slot, and a coupling shaft passes through the through holes in the straight slot and the through hole in the lug to connect the fixing part and the bending part together.

An external thread is provided on a lower part of the bending part, a screw hole is provided at a periphery of the press ring, and the lower part of the bending part is fixed by a nut after passing through the screw hole.

The translucent cover is a glass translucent cover.

A space is preserved between the press ring and the base plate.

The installation column-shaped bolt between the press ring and the base plate is designed as a bendable structure in the present application, one end of the press ring can be connected in advance to a bendable installation column-shaped bolt on the base plate before installing the translucent cover, the press ring is allowed to be in a state of opening downward by using the bendable structure of the installation column-shaped bolt, and at this time, after installing the translucent cover on the base plate, it only needs one hand to connect the other end of the press ring to other installation column-shaped bolts. The design of the installation column-shaped bolt with a bendable structure makes it convenient for the installation of the ceiling lamp.

BRIEF DESCRIPTION OF THE DRAWINGS

The present application is further elaborated according to the accompanying drawings and specific implementations hereinafter.

DETAILED DESCRIPTION OF EMBODIMENTS

Figure 1:
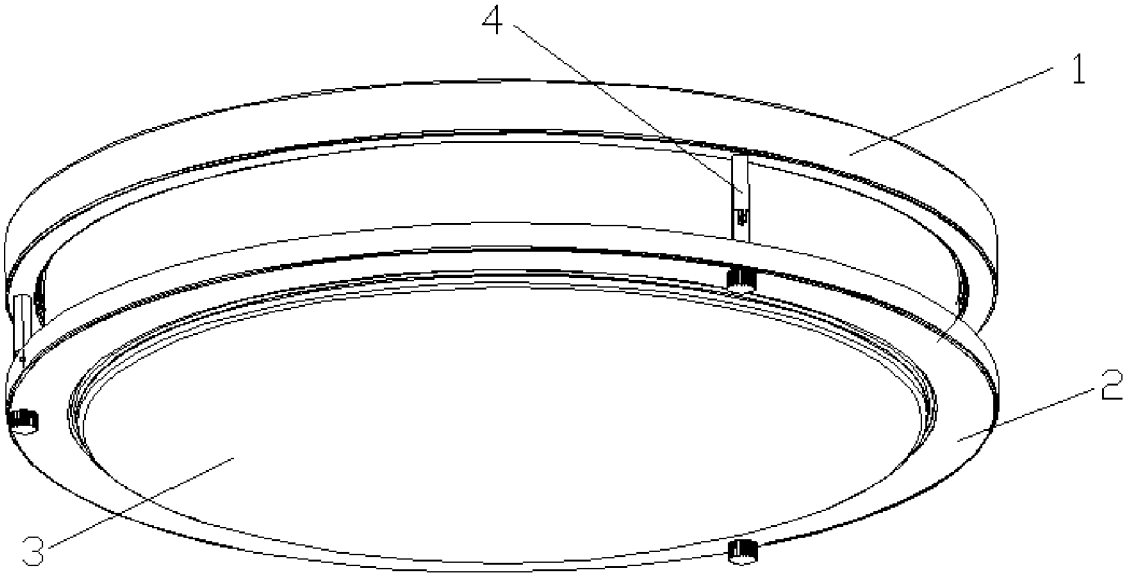
FIG. 1 is a schematic view showing the overall structure of a ceiling lamp according to an embodiment of the present application.
Figure 2:
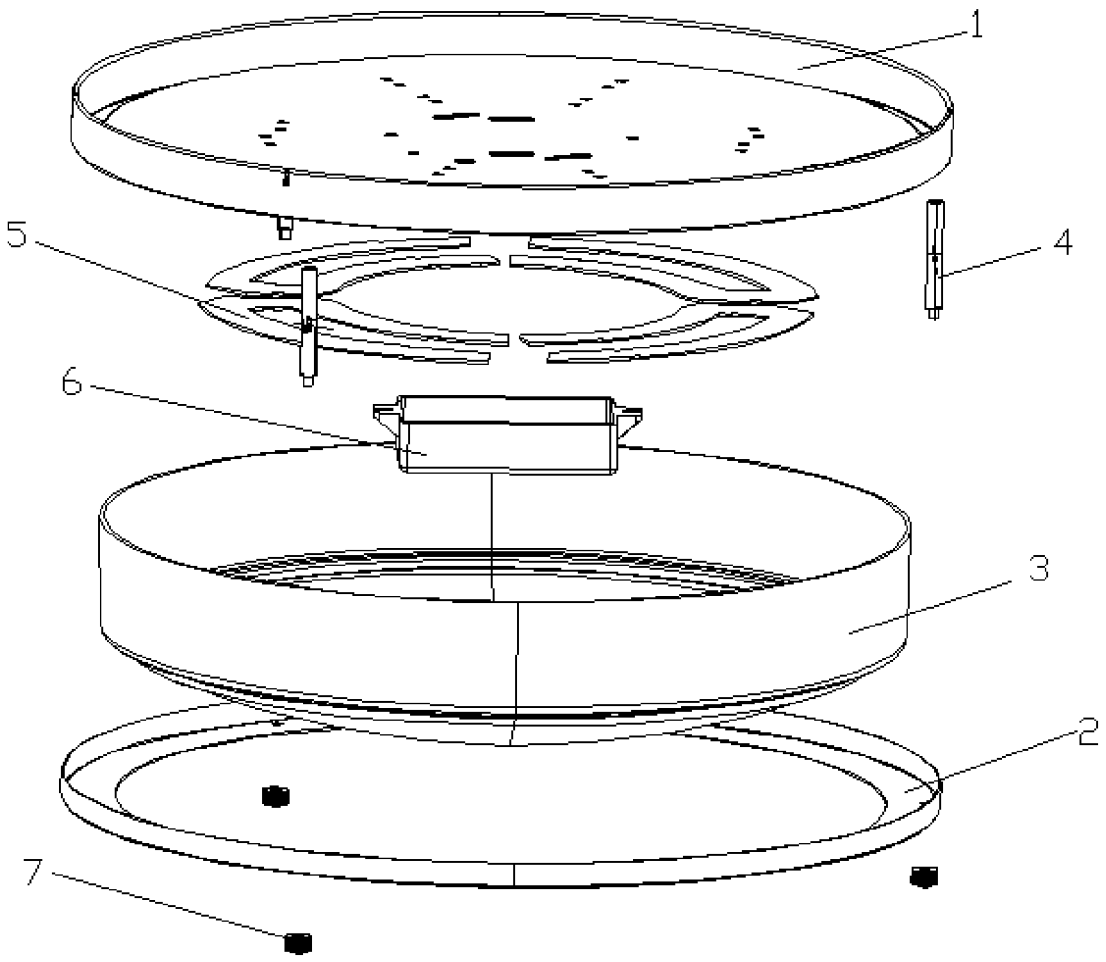
FIG. 2 is an exploded view of the ceiling lamp according to an embodiment of the present application.

An easy-to-install light-emitting diode (LED) double-ring ceiling lamp is provided according to this embodiment, as shown in FIG. 1 and FIG. 2. Its structure mainly includes a base plate 1, a LED light source board 5, a driving power supply 6, a glass translucent cover 3 and a press ring 2. The base plate 1 is a metal disc with a bottom surface, the driving power supply 6 is installed at the middle of the bottom surface of the base plate 1, and the LED light source board 5 is installed around the driving power supply 6. A ring slot is provided in the bottom surface of the base plate 1, and an edge of the glass translucent cover 3 is placed in the ring slot, such that the glass translucent cover 3 is covered on the base plate 1. Multiple installation column-shaped bolts 4 are provided on an outer circumference of the ring slot in the base plate 1, an outer part of the glass translucent cover 3 is supported by the press ring 2 which is a metal circular ring. A large space is preserved between the press ring 2 and the base plate 1 for facilitating the installation and operation of the translucent cover 3, and the press ring 2 is detachably connected to the base plate 1 by the multiple installation column-shaped bolts 4.

Figure 3:
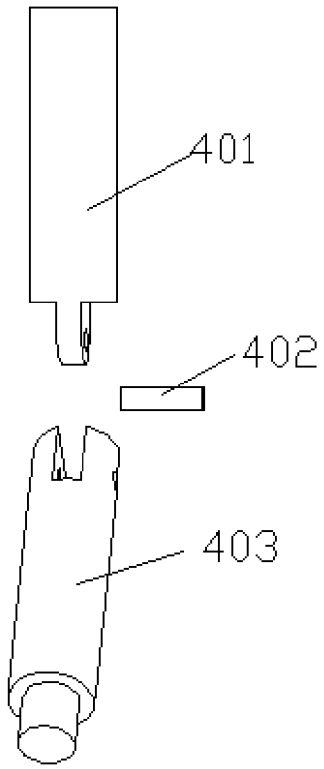
FIG. 3 is an exploded view of a bendable installation column-shaped bolt.
Figure 4:
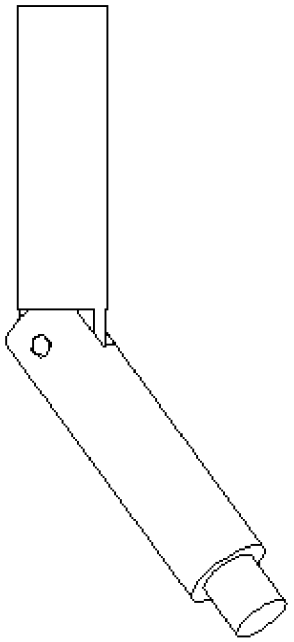
FIG. 4 is a schematic view showing the assembly structure of the bendable installation column-shaped bolt.

At least one of the multiple installation column-shaped bolts 4 is a bendable installation column-shaped bolt 4 as shown in FIG. 3 and FIG. 4. The bendable installation column-shaped bolt 4 is to facilitate the pre-connection between one end of the press ring 2 and the base plate 1 during the installation of the ceiling lamp. The structure of the bendable installation column-shaped bolt 4 in this embodiment is shown in FIG. 3 and FIG. 4. The bendable installation column-shaped bolt 4 includes a fixing part 401, a bending part 403 and a coupling shaft 402. A top end of the fixing part 401 is connected to the base plate 1, a bottom end of the fixing part 401 is hinged with a top end of the bending part 403 by the coupling shaft 402, and a bottom end of the bending part 403 is connected to the press ring 2. The top end of the fixing part 401 can be directly fixed on the base plate 1 in a form that it is integrally connected to the base plate 1, and alternatively, screw column-shaped bolts may be set on the base plate 1 first, screw holes are provided in the top of the fixing part 401, and the top end of the fixing part 401 is installed on the base plate 1 by the cooperation between the screw columns and the screw holes. A lug is provided at the bottom of the fixing part 401, and a through hole is provided in the lug. A straight slot is provided longitudinally in the top of the bending part 403, and through holes passing through the straight slot are provided symmetrically in two side walls of the straight slot. The lug is inserted into the straight slot, and the coupling shaft 402 passes through the through holes in the side walls of the straight slot and the through hole in the lug, such that the fixing part 401 and the bending part 403 are hinged together, and the bending part 403 can rotate along a vertical direction. A threaded column-shaped bolt with a diameter smaller than a diameter of a main body of the bending part 403 is provided at the bottom of the bending part 403, a screw hole is provided in the periphery of the bottom of the press ring 2 at a position corresponding to the installation column-shaped bolt 4, and the threaded column-shaped bolt is tightened and fixed by a nut 7 after the threaded column-shaped bolt at the bottom of the bending part 403 passes through the screw hole in the press ring 2.

Figure 5:
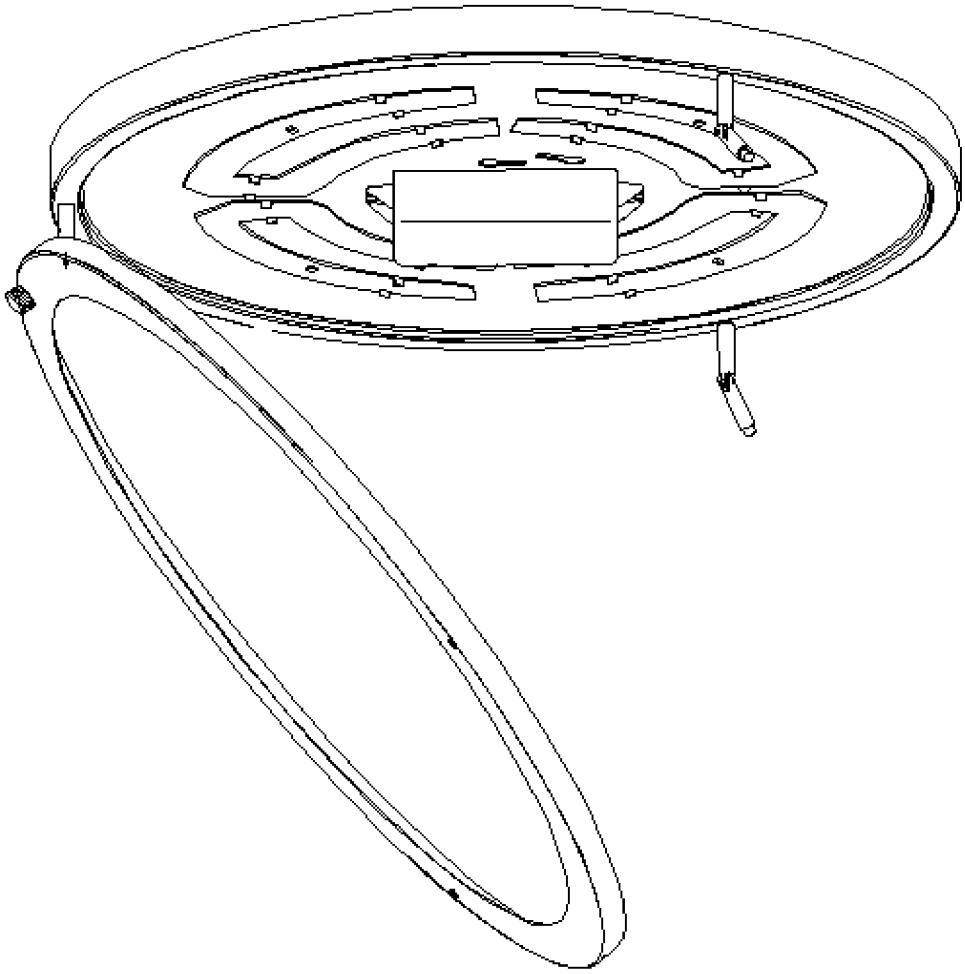
FIG. 5 is a schematic view showing the structure of a base plate and a press ring which are pre-connected during the installation of a ceiling lamp.
Figure 6:
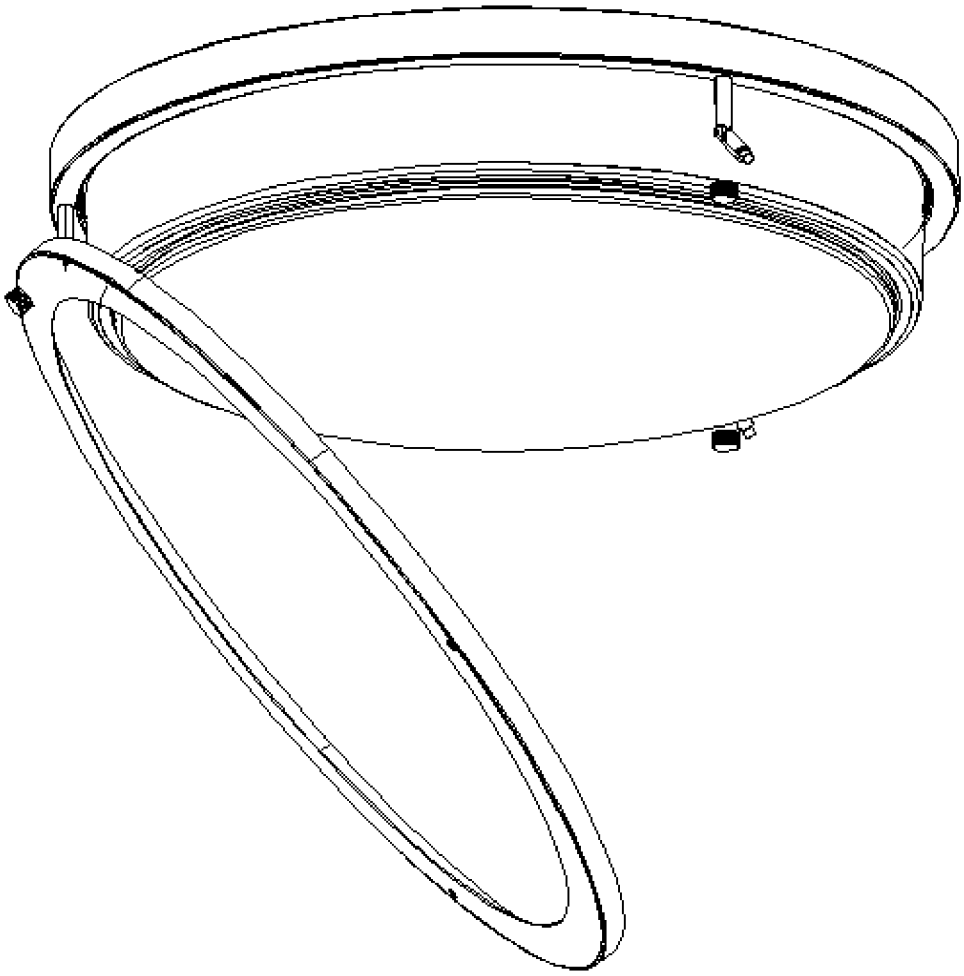
FIG. 6 is a schematic state view when installing a translucent cover.

When installing the ceiling lamp provided in this embodiment, firstly, as shown in FIG. 5, the press ring 2 is connected to any one of the bendable installation column-shaped bolts 4 on the base plate 1 in accordance with the above-described manner. Through the bending effect of the installation column-shaped bolt 4, the press ring 2 can be hung at one side below the base plate 1, and thus one side of the press ring 2 is fixed to the base plate 1, and another side of the press ring 2 is free. Since that a large space is preserved between the base plate 1 and the press ring 2, the installation of the glass translucent cover 3 will not be obstructed. After the press ring 2 is hung, further referring to FIG. 6, the edge of the glass translucent cover 3 is embedded into the ring slot of the base plate 1, the glass translucent cover 3 is supported by one hand, and the free side of the press ring 2 is installed by the other hand onto another installation column-shaped bolt 4 by the nut 7 for positioning, and then the remaining installation column-shaped bolts 4 are connected and fixed in sequence.

The above embodiments are only listed for illustrating technical solutions of the present application rather than limiting the technical solutions of the present application. Modifications and equivalent replacements made to the technical solutions of the present application by one skilled in the art, without deviating from the spirit and scope of the technical solutions of the present application, are all deemed to fall within the scope of claims of the present application.

What is claimed is:

1. An easy-to-install light-emitting diode (LED) double-ring ceiling lamp, comprising: a base plate, a LED light source board, a driving power supply, a translucent cover and a press ring, wherein the LED light source board and the driving power supply are installed on the base plate, the translucent cover is covered on the base plate, the press ring is covered outside the translucent cover and configured to support the translucent cover, the press ring and the base plate are detachably connected by a plurality of installation column-shaped bolts, and at least one of the plurality of installation column-shaped bolts is a bendable installation column-shaped bolt.

2. The easy-to-install LED double-ring ceiling lamp according to claim 1, wherein, the bendable installation column-shaped bolt comprises a fixing part and a bending part, a top end of the fixing part is connected to the base plate, a bottom end of the fixing part is hinged with a top end of the bending part, and a bottom end of the bending part is connected to the press ring.

3. The easy-to-install LED double-ring ceiling lamp according to claim 2, wherein, the top end of the fixing part is integrally connected to the base plate.

4. The easy-to-install LED double-ring ceiling lamp according to claim 2, wherein, a threaded hole is provided in the top end of the fixing part, a threaded column-shaped bolt is provided on the base plate, and the top end of the fixing part is threadedly connected to the threaded column-shaped bolt.

5. The easy-to-install LED double-ring ceiling lamp according to claim 3, wherein, a lug is provided at a bottom of the fixing part, and a through hole is provided in the lug; a straight slot for accommodating the lug is provided in a top of the bending part, and through holes are provided symmetrically in side walls of the straight slot, the lug is embedded into the straight slot, and a coupling shaft passes through the through holes in the straight slot and the through hole in the lug to connect the fixing part and the bending part together.

6. The easy-to-install LED double-ring ceiling lamp according to claim 5, wherein, an external thread is provided on a lower part of the bending part, a screw hole is provided at a periphery of the press ring, and the lower part of the bending part is fixed by a nut after passing through the screw hole.

7. The easy-to-install LED double-ring ceiling lamp according to claim 4, wherein, a lug is provided at a bottom of the fixing part, and a through hole is provided in the lug; a straight slot for accommodating the lug is provided in a top of the bending part, and through holes are provided symmetrically in side walls of the straight slot, the lug is embedded into the straight slot, and a coupling shaft passes through the through holes in the straight slot and the through hole in the lug to connect the fixing part and the bending part together.

8. The easy-to-install LED double-ring ceiling lamp according to claim 7, wherein, an external thread is provided on a lower part of the bending part, a screw hole is provided at a periphery of the press ring, and the lower part of the bending part is fixed by a nut after passing through the screw hole.

9. The easy-to-install LED double-ring ceiling lamp according to claim 1, wherein, the translucent cover is a glass translucent cover.

10. The easy-to-install LED double-ring ceiling lamp according to claim 1, wherein, a large space is preserved between the press ring and the base plate.

* * * * *